US007255085B2

(12) United States Patent
Shin

(10) Patent No.: US 7,255,085 B2
(45) Date of Patent: Aug. 14, 2007

(54) TIMING COVER FOR ENGINE

(75) Inventor: Bo Sung Shin, Suwon-si (KR)

(73) Assignee: Hyundai Motor Company, Seocho-Ku, Seoul (KR)

( * ) Notice: Subject to any disclaimer, the term of this patent is extended or adjusted under 35 U.S.C. 154(b) by 0 days.

(21) Appl. No.: 11/314,352

(22) Filed: Dec. 20, 2005

(65) Prior Publication Data

US 2006/0150942 A1 Jul. 13, 2006

(30) Foreign Application Priority Data

Dec. 22, 2004 (KR) ..... 10-2004-0110757

(51) Int. Cl.
*F02B 77/00* (2006.01)

(52) U.S. Cl. ..... 123/195 C

(58) Field of Classification Search ..... 123/195 C
See application file for complete search history.

(56) References Cited

U.S. PATENT DOCUMENTS 4,395,982 A * 8/1983 Moller ..... 123/195 C
4,480,609 A 11/1984 Hayashi
6,050,236 A * 4/2000 Sawaki et al. ..... 123/195 C

FOREIGN PATENT DOCUMENTS

JP 10220287 A * 8/1998
JP 2001-342845 12/2001
KR 99042876 A * 6/1999

* cited by examiner

*Primary Examiner*—Noah P. Kamen
(74) *Attorney, Agent, or Firm*—Morgan Lewis & Bockius LLP

(57) ABSTRACT

A timing cover for an engine includes a plurality of dome-shaped embossed portions formed at positions of the timing cover that are most susceptible to vibration, based on an analysis of vibration modes of the timing cover.

10 Claims, 9 Drawing Sheets

TIMING COVER FOR ENGINE

CROSS-REFERENCE TO RELATED APPLICATION

This application claims priority to and the benefit of Korean Patent Application No. 10-2004-0110757 filed in the Korean Intellectual Property Office on Dec. 22, 2004, the entire contents of which are incorporated herein by reference.

BACKGROUND OF THE INVENTION

1. Field of the Invention

The present invention relates to a timing cover for an engine, and more particularly to a timing cover with a high characteristic frequency band.

2. Description of the Related Art

Generally, an engine for a vehicle serves as a power generating device. The engine draws a fuel-air mixture into a combustion chamber by the operation of a suction system and a fuel system, and bums the fuel-air mixture by the operation of a combustion system, thereby generating driving force necessary to drive the vehicle.

During driving, the engine generates vibration and noise due to periodic variations in a central position according to the vertical motion of a piston and a connecting rod. Variations in inertial force are generated from the reciprocating motion of a cylinder in an axial direction. Variations in inertial force are generated from the motion of the connecting rod in the right and left direction of a crank shaft, and periodic variations in rotating force are applied to the crank shaft.

The above vibration and noise generated from the engine due to the above variations affect other peripheral components located around the engine, thereby causing other vibrations and noises. A representative one of the peripheral components is a timings cover for covering a timing belt or a timing chain interlocking a crank shaft and a cam shaft.

The timing cover is connected to one side of a cylinder block of an engine, and serves to prevent a sprocket installed on the crank shaft, a sprocket installed on the cam shaft, and a timing belt or a timing chain for interconnecting the sprockets from being exposed to the outside.

Since the conventional timing cover is connected to the cylinder block of the engine, the conventional timing cover resonates with the vibration generated by the engine. The characteristic vibration and noise generated from the driving of the timing belt or the timing chain causes another vibration and noise at a different frequency band.

The above vibration and noise generated from the timing cover deteriorate silence of the vehicle, and provide unpleasantness to passengers in the vehicle, thereby serving as a factor in reducing the comfort of passengers riding in the vehicle.

A structure in which a plurality of reinforcing ribs are formed on the inner surface of a timing cover, so that the structural rigidity of the timing cover is improved, and in which the characteristic frequency band of the timing cover can be deviated from the characteristic frequency band of the engine, has been proposed. However, the above conventional structure has only a small effect of the decrease in the vibration of the timing cover in proportion to the increase in the weight of the timing cover, thus not obtaining satisfying results.

SUMMARY OF THE INVENTION

Embodiments of the present invention have provide a timing cover for an engine, which is connected to a cylinder block, covers a sprocket of a crank shaft, a sprocket of a cam shaft, and a timing belt or a timing chain for interconnecting the sprockets, and comprises a plurality of dome-shaped embossed portions formed thereon, thereby causing the characteristic frequency band thereof to deviate from a characteristic frequency of the engine.

In accordance with an exemplary embodiment of the present invention, a timing cover for an engine may comprise: a connecting portion connected to a cylinder block, a shielding portion for covering a timing belt or a timing chain, and at least one embossed portion formed on the shielding portion for increasing a characteristic frequency of the timing cover.

One side surface of the at least one the embossed portion facing the cylinder block may be concave and the other side surface of the at least one embossed portion may be protruded outwardly. A plurality of the embossed portions may be formed on the shielding portion.

First, second, and third embossed portions may be formed on the shielding portion. The first embossed portion may be formed at the central position of the shielding portion, the second embossed portion may be formed at a position of the shielding portion located slantingly below the first embossed portion, and the third embossed portion may be formed at a position of the shielding portion located above the first embossed portion. The first embossed portion may have a radius of 35 mm and a height of 4 mm, the second embossed portion may have a radius of 30 mm and a height of 3 mm, and the third embossed portion may have a radius of 30 mm and a height of 5 mm. The embossed portions may have different radii and heights.

Further, the at least one embossed portion may be formed at a position of the shielding portion which is proved to generate the largest vibration displacement through the analysis of vibration modes of the timing cover.

The timing cover may further comprise a cover portion formed integrally with the shielding portion for covering a continuous variable valve timing device, and a support bracket formed integrally with the shielding portion for mounting an engine mount thereon. The at least one embossed portion may have a dome shape.

Since a plurality of dome-shaped embossed portions are formed at positions of the timing cover which are proved to be the most susceptible to vibration through the analysis of vibration modes of the timing cover, the timing cover of the present invention has a high characteristic frequency, thereby avoiding a frequency band generated from the engine during driving at a normal rotation frequency and drastically reducing the generation of vibration.

The timing cover of an exemplary embodiment of the present invention has a reinforced structural rigidity without a plurality of reinforcing ribs, thereby deviating the characteristic frequency band thereof from a characteristic frequency band generated from the engine during driving.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Exemplary embodiments of the present invention will be described in more detail with reference to the annexed drawings.

Figure 1:
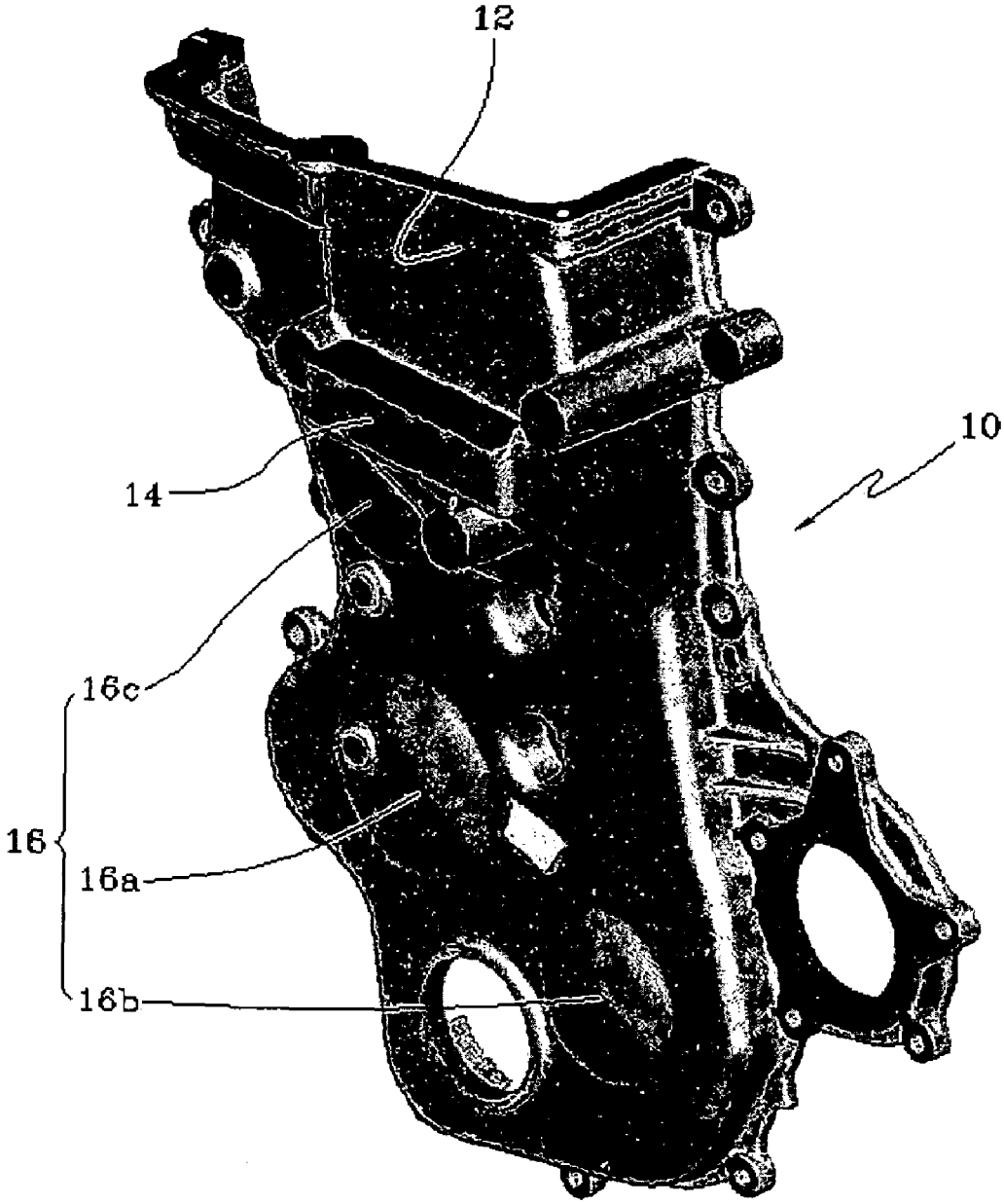
FIG. 1 is a front perspective view of a timing cover for an engine in accordance with a first embodiment of the present invention.

FIG. 1 illustrates the timing cover 10 connected to one side of a cylinder block (not shown). The timing cover 10 comprises a cover portion 12 formed on the upper end thereof for covering a continuous variable valve timing device, and a support bracket 14 protruded outwardly from the lower portion for mounting an engine mount (not shown). Here, the cover portion 12 and the support bracket 14 may be integrally formed.

A timing cover 10 having the above structure is provided with a front surface connected to one side of the cylinder block, and covers a sprocket (not shown) installed on a crank shaft, a sprocket (not shown) installed on a cam shaft, and a timing belt or a timing chain (not shown) for interlocking the sprockets.

A plurality of embossed portions 16 having a hemispheric dome shape are formed on the timing cover 10. The embossed portions 16 protrude from the outer surface of the timing cover 10, thereby reinforcing the structural rigidity of the timing cover 10.

The embossed portions 16 are formed at positions on the timing cover 10 which are proved to generate the largest vibration displacement through the analysis of the vibration modes of the timing cover 10. During the analysis of the vibration modes, external appearance characteristics of the timing cover 10, for example, dimensions, thickness, and the material of the timing cover 10 determined by the whole shape of the timing cover 10, are considered.

The positions of the embossed portions 16 are varied according to the external characteristics of the timing cover 10. In one exemplary embodiment as shown in the figures, the embossed portions 16 comprise a first embossed portion 16*a* formed at the central position of the timing cover 10, a second embossed portion 16*b* formed at a position of the timing cover 10 located slantingly below the first embossed portion 16*a*, and a third embossed portion 16*c* formed at a position of the timing cover located above the first embossed portion 16*a*. The first, second, and third embossed portions 16*a*, 16*b*, and 16*c* in one exemplary embodiment, respectively have radii of about 35 mm, 30 mm, and 30 mm, and heights of about 4 mm, 3 mm, and 5 mm.

When a plurality of the dome-shaped embossed portions 16*a*, 16*b*, and 16*c* are formed at positions on the timing cover 10, which are proved to be the most susceptible to vibration through the analysis of the vibration modes of the timing cover 10, the timing cover 10 has a higher characteristic frequency band than that of the conventional timing cover. The characteristic frequency band of the timing cover 10 of an exemplary embodiment of the present invention deviates from a frequency band of vibration generated from an engine during driving at a normal rotation frequency (i.e., at approximately 2,000~2,500 rpm of a gasoline engine or at approximately 1,500~2,000 rpm of a diesel engine).

As a result, when the above timing cover 10 is connected to a cylinder block of an engine and an influence of vibration generated from the engine during driving at a normal rotation frequency on the timing cover 10 is analyzed, the timing cover 10 is scarcely affected by the frequency band of the vibration generated during the driving of the engine. That is, the vibration generated from the timing cover 10 according to resonance was drastically reduced.

Hereinafter, with reference to FIGS. 3 to 6, a process for analyzing the vibration modes of the above timing cover of the present invention will be described in detail. The timing cover of an exemplary embodiment of the present invention aims to have a characteristic frequency of at least about 2,222 Hz.

Figure 3:
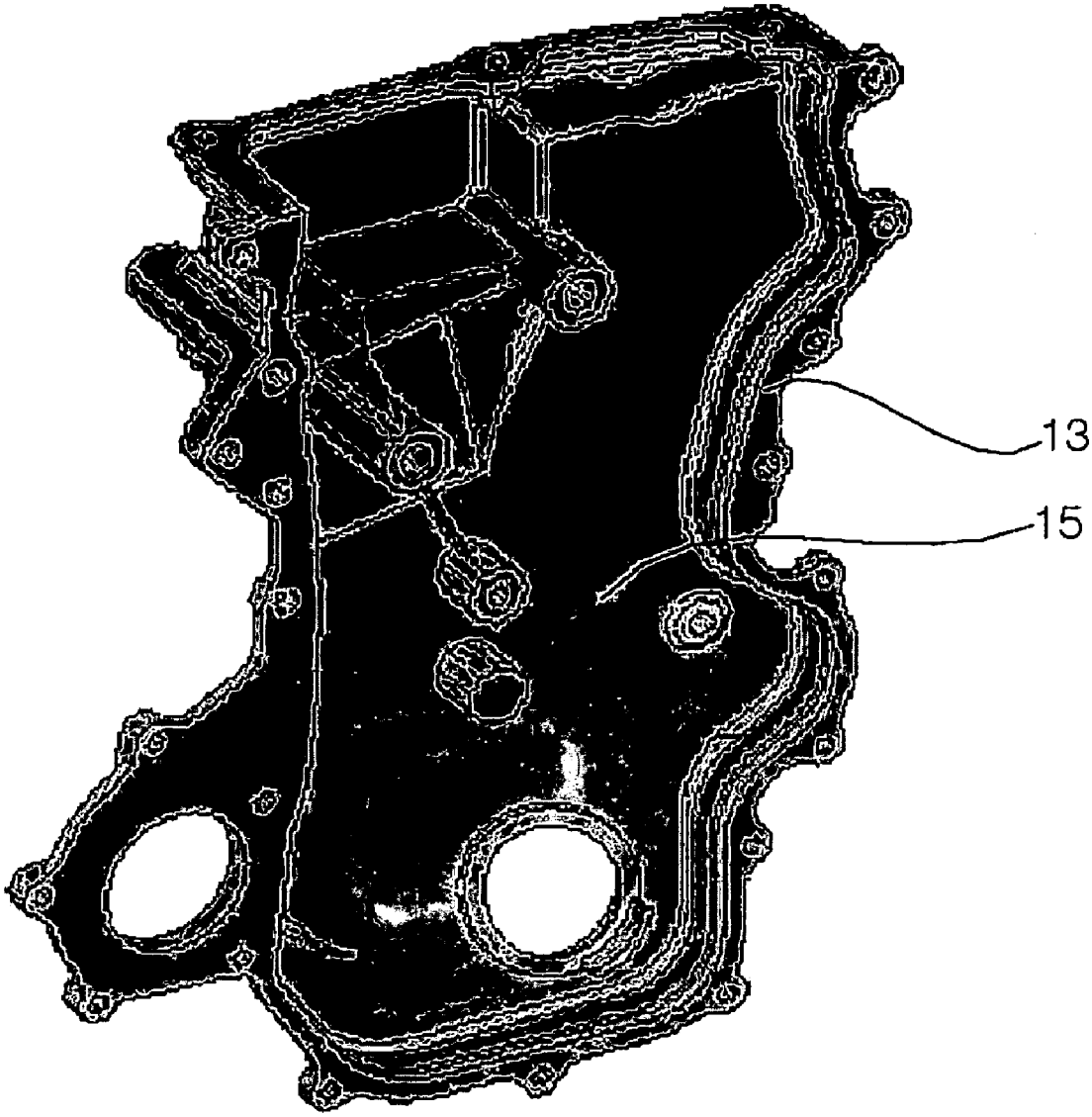
FIG. 3 is a perspective view of a general timing cover.

As shown in FIG. 3, the general timing cover comprises an edge portion 13 connected to a cylinder block, and a shielding portion 15 for covering a sprocket installed on a crank shaft, a sprocket installed on a cam shaft, and a timing belt or a timing chain (not shown) for interlocking the sprockets. The edge portion 13 protrudes towards the cylinder block, and the edge portion 13 and the shielding portion 15 form a designated space.

In the general timing cover, as shown in FIG. 3, a peak in a characteristic frequency is generated at the shielding portion 15. Here, the characteristic frequency is about 1,147 Hz.

The timing cover of the present invention further comprises a first rib 15*a* formed on the shielding portion 15. The timing cover of the present invention may further comprises a groove 15*b* formed in the shielding portion 15. The first rib 15*a* formed on the shielding portion 15 is connected to a connecting portion 17 formed on the shielding portion 15.

Figure 4A:
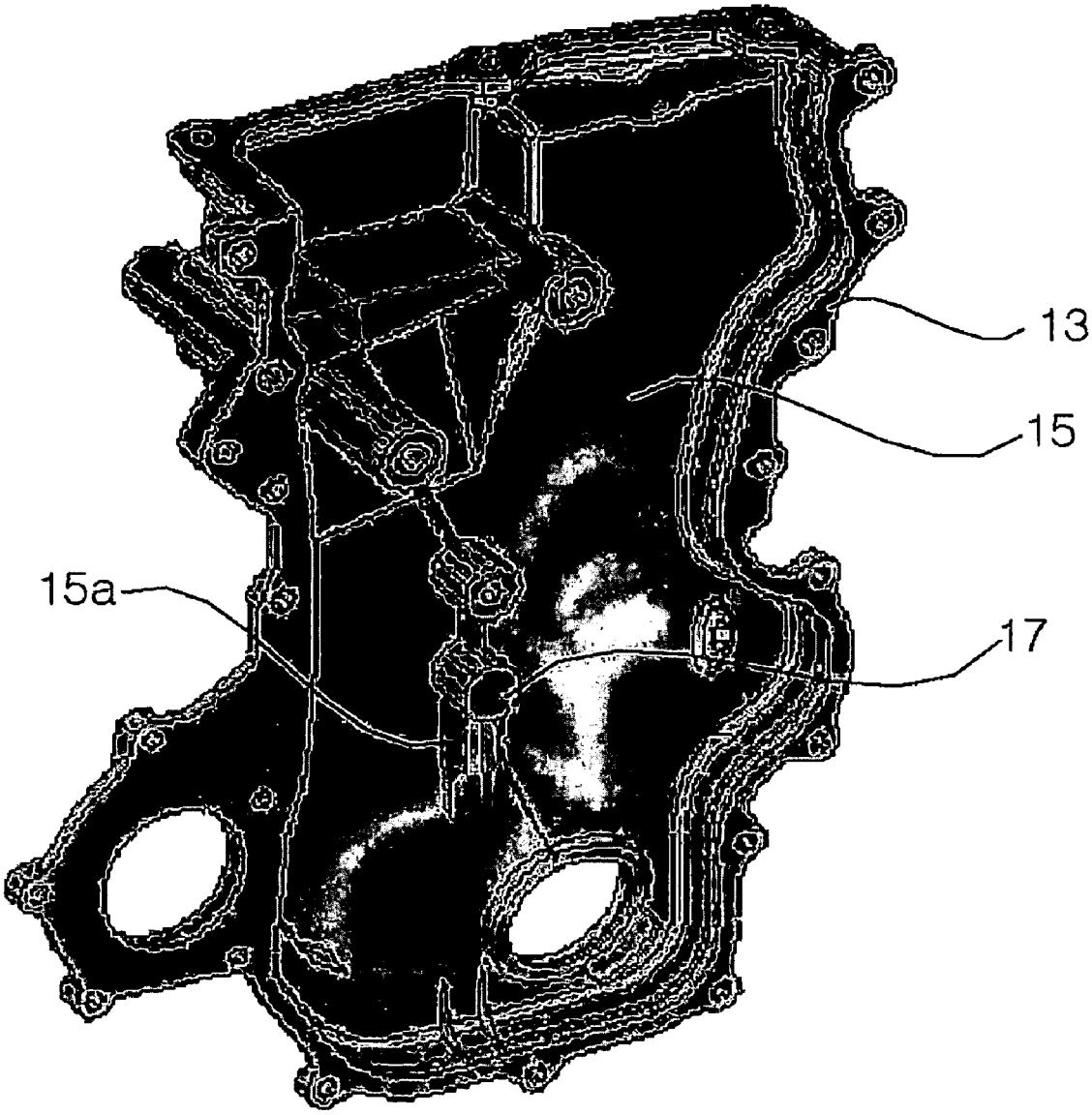
FIGS. 4A and 4B are perspective views illustrating distribution of vibration on timing covers in accordance with second and third embodiments of the present invention.
Figure 4B:
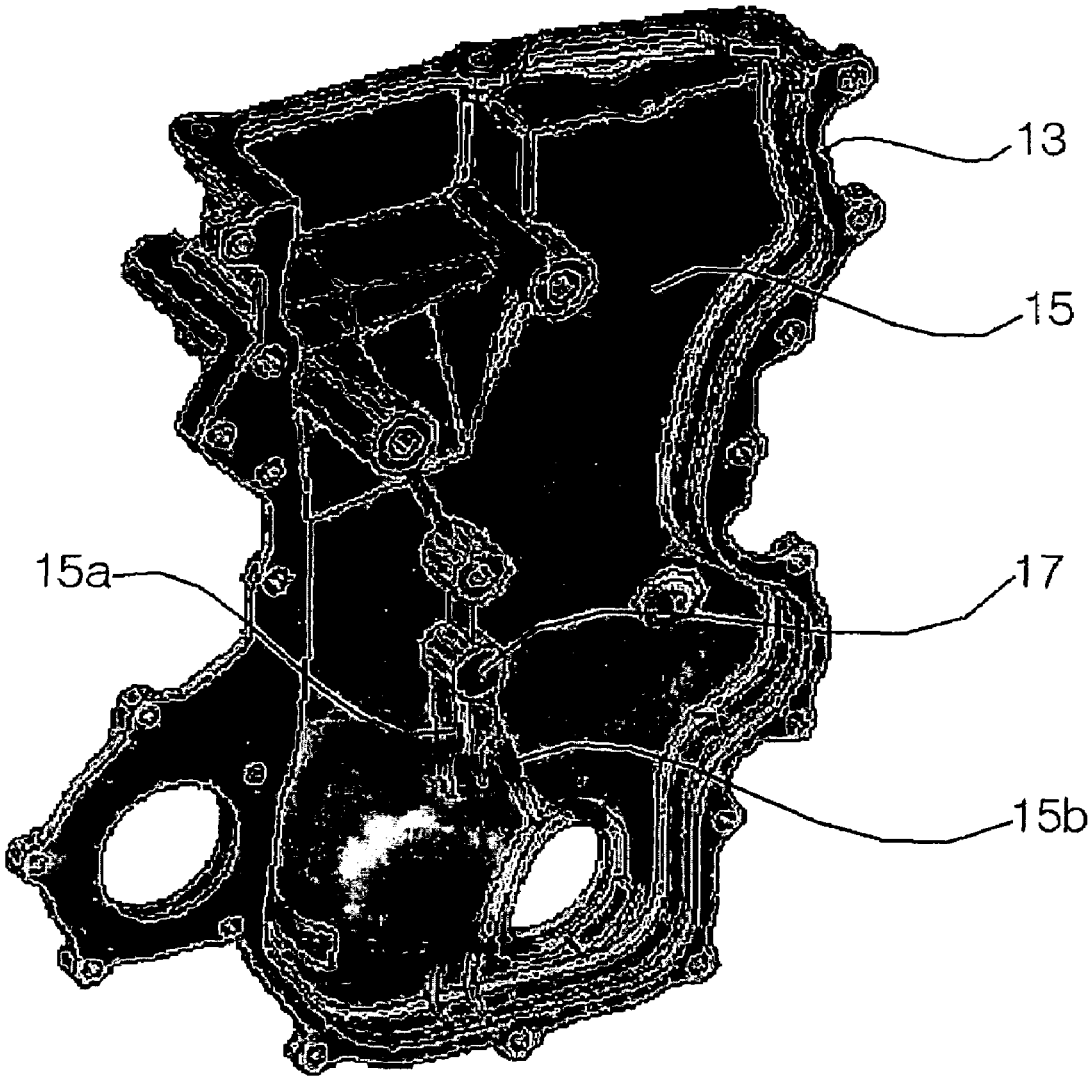

As shown in FIG. 4A, in the case that the first rib 15*a* connected to the connecting portion 17 is formed on the shielding portion 15 of the timing cover, the peak of the characteristic frequency of the timing cover is generated to the right of the ribs 15*a*. The characteristic frequency of the timing cover is about 1,885 Hz. Further, as shown in FIG. 4B, in the case that the groove 15*b* together with the first rib 15*a* is formed in the shielding portion 15 of the timing cover, the characteristic frequency of the timing cover is about 2,036 Hz.

The first rib 15*a* or the groove 15*b*, as described above, increases the strength of the timing cover, thereby raising the characteristic frequency of the timing cover. However, the characteristic frequency of the timing cover having the first rib 15*a* or the groove 15*b* does not reach a target value of about 2,222 Hz.

Since the timing cover having the first rib 15*a* has an increased characteristic frequency much higher than that of the general timing cover, the timing cover employing the first rib 15*a* is selected as a basic model.

Figure 5A:
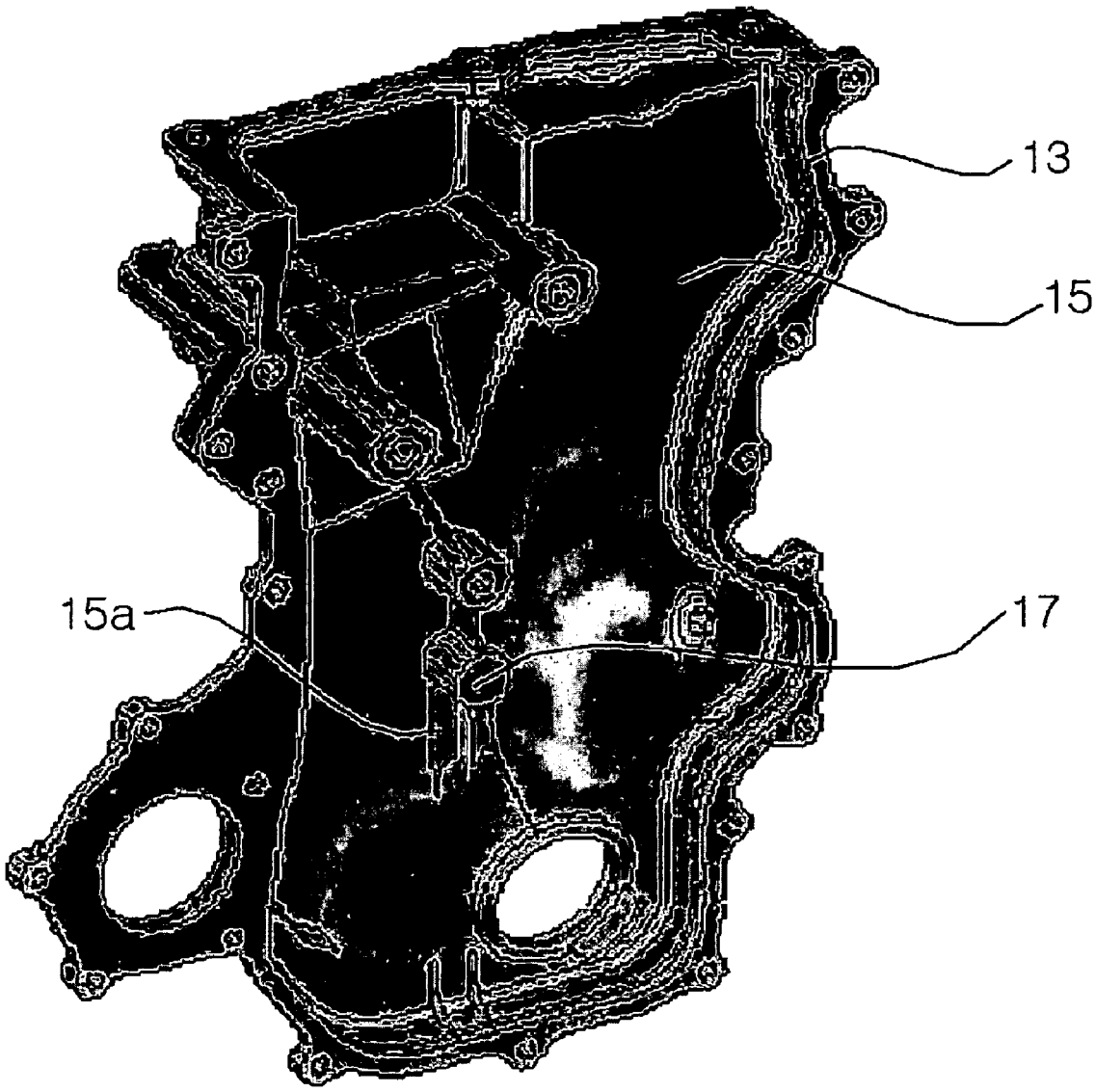
FIGS. 5A, 5B, and 5C are perspective views respectively illustrating distribution of vibration on a timing cover in accordance with a fourth embodiment of the present invention.
Figure 5B:
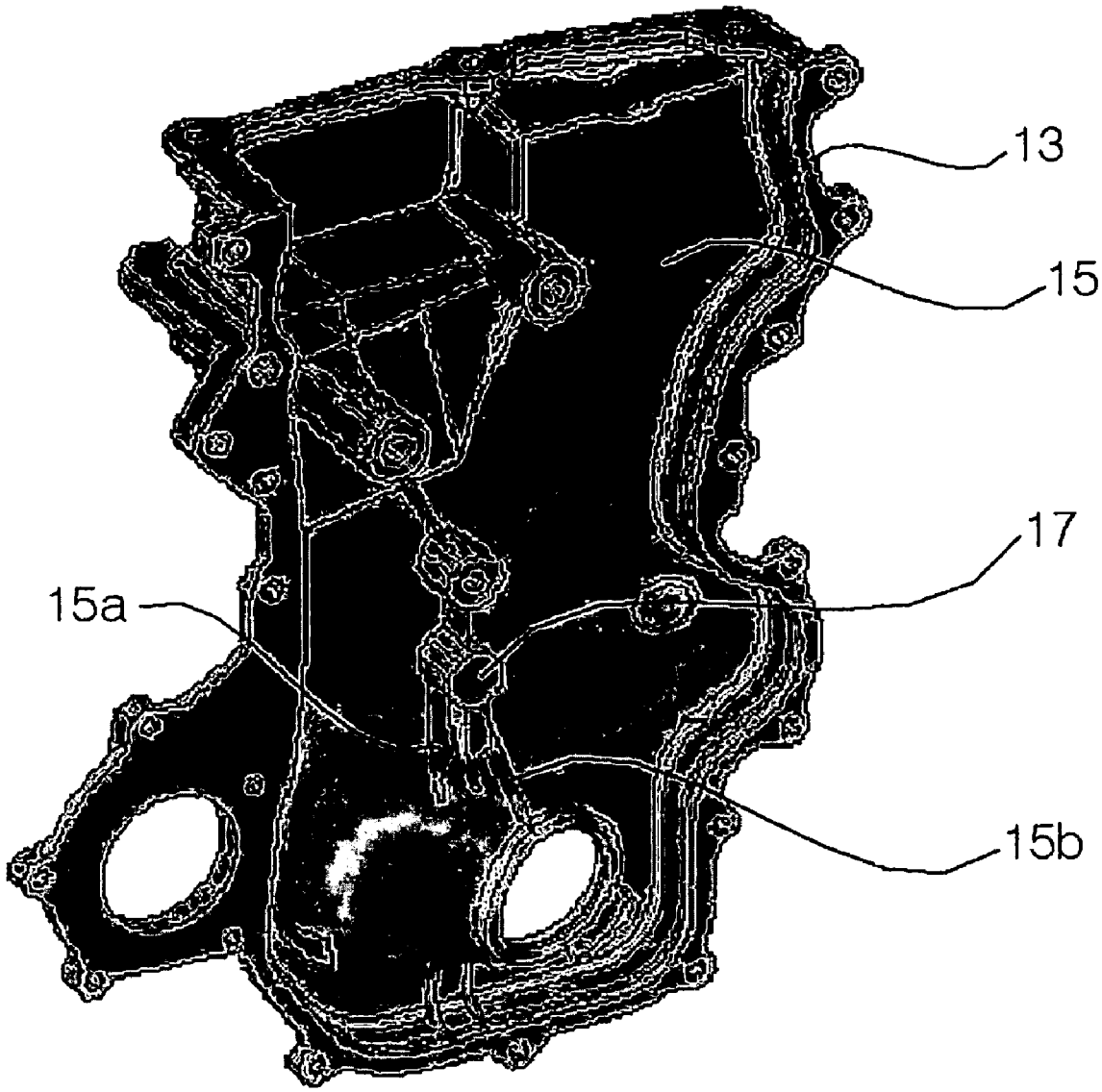
Figure 5C:
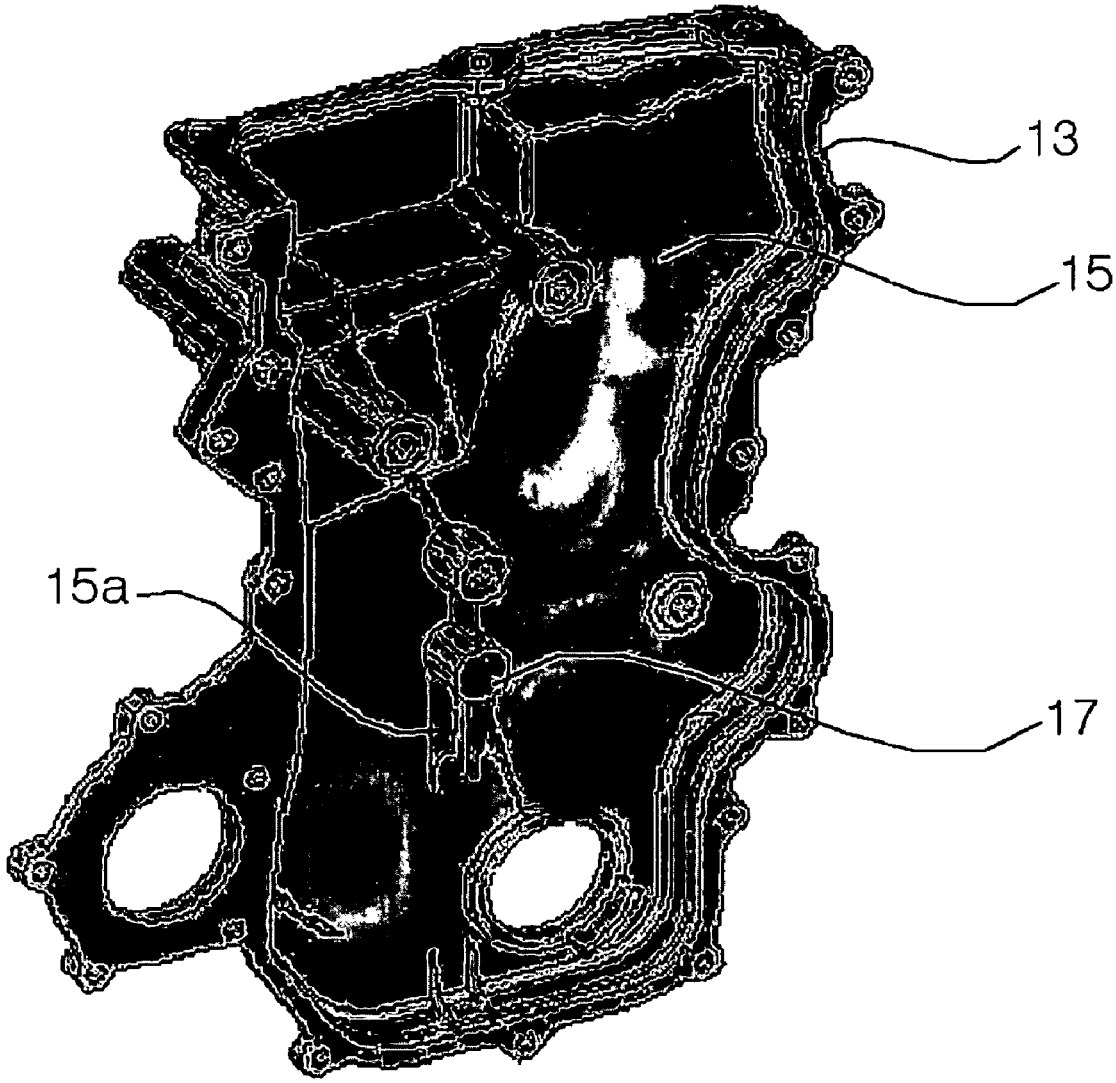

As shown in FIGS. 5A, 5B, and 5C, when an applied frequency is gradually increased, a plurality of peaks of the characteristic frequency is generated at different portions of the basic model of the timing cover.

In the basic model of the timing cover, as shown in FIG. 5A, when a frequency of about 1,885 Hz is applied to the timing cover, a first peak is generated to the right of the first rib 15*a* on the timing cover. As shown in FIG. 5B, when a frequency of about 2,036 Hz is applied to the timing cover, a second peak is generated to the left of the first rib 15*a* on the timing cover. As shown in FIG. 5C, when a frequency of about 2,343 Hz is applied to the timing cover, a third peak is generated above and to the right of the connecting portion 17 on the timing cover.

By eliminating the above three peaks formed on the timing cover, the timing cover of the present invention has a characteristic frequency exceeding the target value of about 2,222 Hz.

Figure 2:
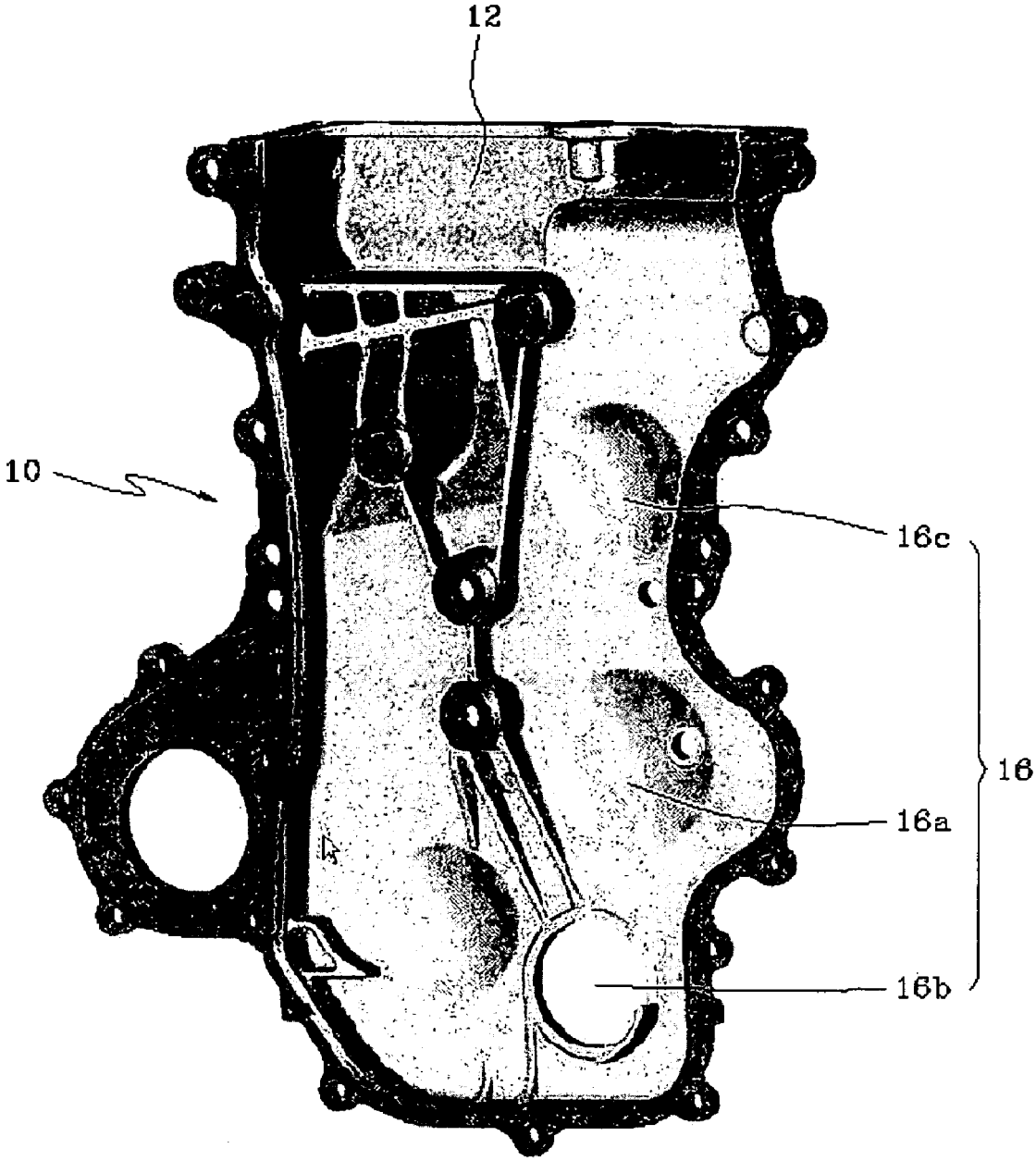
FIG. 2 is a rear perspective view of the timing cover of FIG. 1.

Since the timing cover of embodiments of the present invention has the three embossed portions 16*a*, 16*b*, and 16*c* formed at the above three portions of the timing cover, at which the first, second, and third peaks are generated, the timing cover has a characteristic frequency of about 2,415 Hz. Compared to the timing cover comprising the three embossed portions 16*a*, 16*b*, and 16*c* having the same radius and height, the timing cover comprising the three embossed portions 16*a*, 16*b*, and 16*c* having different radii and heights, as shown in FIG. 2, has an increased characteristic frequency.

Figure 6:
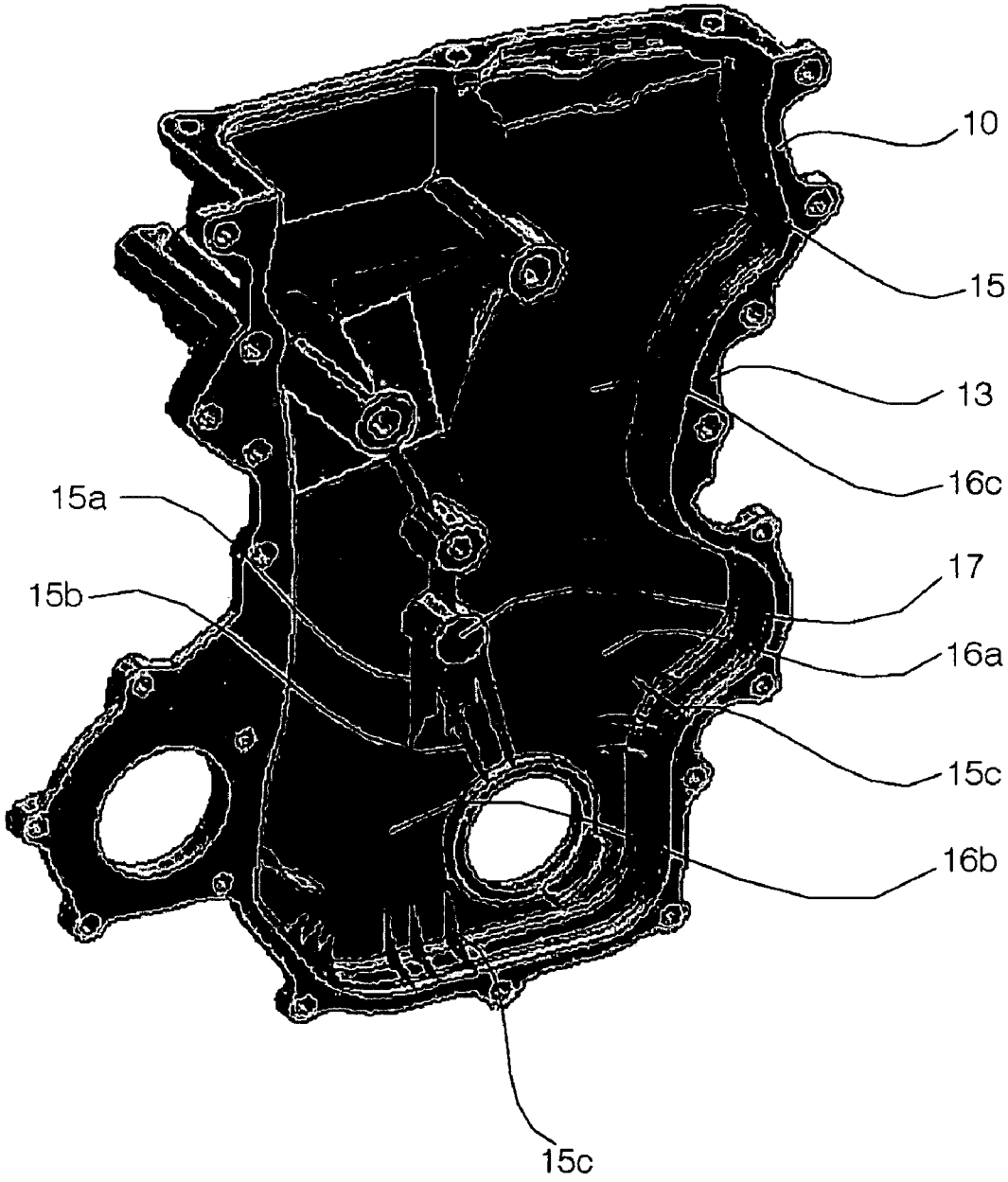
FIG. 6 is a perspective view of timing cover in accordance with a sixth embodiment of the present invention.

As shown in FIG. 6, the improved timing cover of another embodiment of the present invention further comprises a second rib 15*c,* in addition to the first rib 15*a* and the groove 15*b,* thereby having a further increased strength. The improved timing cover comprising the first rib 15*a,* the groove 15*b,* and the second rib 15*c* has a characteristic frequency of about 2,602 Hz.

As apparent from the above description, the present invention provides a timing cover for an engine, which comprises a plurality of dome-shaped embossed portions formed at locations found to be the most susceptible to vibration through the analysis of vibration modes of the timing cover. A timing cover according to embodiments of the present invention thus has a high characteristic frequency. Thereby, the timing cover of the present invention avoids a frequency band of vibration generated from the engine during driving at a normal rotation frequency, thus drastically reducing the generation of vibration.

The timing cover of the present invention also may have a reinforced structural rigidity without a plurality of reinforcing ribs, as formed on in the conventional timing cover, thereby deviating the characteristic frequency band thereof from a characteristic frequency band generated from the engine during driving.

The timing cover of embodiments of the present invention has embossed portions having different radii and heights, thereby having an improved rigidity and an increased characteristic frequency.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A timing cover for an engine, comprising:

a connecting portion configured for connection to a cylinder block;

a shielding portion configured and dimensioned to cover a timing belt or a timing chain;

a first embossed portion at a central position of the shielding portion;

a second embossed portion at a position of the shielding portion located slantingly below the first embossed portion; and a third embossed portion at a position of the shielding portion located above the first embossed portion.

2. The timing cover as set forth in claim 1, wherein a first surface of each of the embossed portions is concave and a second surface of each of the embossed portions protrudes outwardly.

3. The timing cover as set forth in claim 1, wherein the first embossed portion has a radius of about 35 mm and a height of about 4 mm.

4. The timing cover as set forth in claim 1, wherein the second embossed portion has a radius of about 30 mm and a height of about 3 mm.

5. The timing cover as set forth in claim 1, wherein the third embossed portion has a radius of about 30 mm and a height of about 5 mm.

6. The timing cover as set forth in claim 1, further comprising a cover portion formed integrally with the shielding portion that covers a continuous variable valve timing device.

7. The timing cover as set forth in claim 1, further comprising a support bracket formed integrally with the shielding portion that mounts an engine mount thereon.

8. The timing cover as set forth in claim 1, wherein each of the embossed portions comprises a dome shape.

9. A timing cover for an engine, comprising:

a connecting portion configured for connection to a cylinder block;

a shielding portion configured and dimensioned to cover a timing belt or a timing chain; and a plurality of embossed portions formed on the shielding portion;

wherein at least two of the embossed portions have different radii.

10. A timing cover for an engine, comprising:

a connecting portion configured for connection to a cylinder block;

a shielding portion configured and dimensioned to cover a timing belt or a timing chain; and a plurality of embossed portions formed on the shielding portion;

wherein at least two of the embossed portions have different heights.

* * * * *